US005637063A

United States Patent [19]

Fuller, Sr.

[11] Patent Number: 5,637,063

[45] Date of Patent: Jun. 10, 1997

[54] EXERCISE MACHINE FOR CONDITIONING ATHLETES

[76] Inventor: Barney R. Fuller, Sr., P.O. Box 329, Riverside, Tex. 77367

[21] Appl. No.: 587,151

[22] Filed: Jan. 16, 1996

[51] Int. Cl.[6] ..... A63B 71/06

[52] U.S. Cl. ..... 482/97; 482/137; 482/139

[58] Field of Search ..... 482/62, 72, 94, 482/97, 98, 100, 137–139

[56] References Cited

U.S. PATENT DOCUMENTS 4,630,817 12/1986 Buckley ..... 482/62
5,058,884 10/1991 Fuller, Sr. ..... 482/97

FOREIGN PATENT DOCUMENTS 2503568 10/1982 France ..... 482/138

*Primary Examiner*—Richard J. Apley
*Assistant Examiner*—John Mulcahy
*Attorney, Agent, or Firm*—Kenneth A. Roddy

[57] ABSTRACT

An exercise machine has a frame base with a platform at the rearward end upon which the athlete stands. A horizontal shaft rotatably mounted on a pair of vertical frame members near the forward end of the base has an upper central sprocket at its center and smaller sprockets at each end. A weight lever member pivotally connected to a pair of upright frame members extends forwardly therefrom and a number of weights are received on the outer end of the weight lever. A lower central sprocket is rotatably mounted between the upright frame members. A drive arm is arm pivotally connected at its bottom end to the platform. A handlebar rotatably mounted at the upper end of the drive arm is positioned a selective distance above the platform and has hand grips at each end. A first chain wrapped around the upper and lower central sprockets has its free end connected to the drive arm and a pair of second chains each wrapped around an outer sprocket in the opposite direction have their free ends connected to the weight lever member. When the drive arm is pushed pivotally outward by a force on the handlebar, it pulls the first chain down causing rotation of the upper central sprocket and outer sprockets which causes the second chains to pivot the weight lever member upward raising the weights at the outer end thereof and the weight thereof resisting the outward force applied to the handlebar.

3 Claims, 3 Drawing Sheets

EXERCISE MACHINE FOR CONDITIONING ATHLETES

BACKGROUND OF THE INVENTION

1. Field of the Invention

This invention relates generally to the field of sports conditioning exercise machines, and more particularly to an exercise machine for conditioning athletes to forcefully move the hips in a roll and drive motion, pivot the upper torso relative to the lower body, and drive the body and arms forward through a resistive weight load while.

2. Brief Description of the Prior Art

In the sport of football, the most effective way to block an opposing player is to advance toward the opponent while moving horizontally in a crouched position, and upon making contact with the opponent, to exert an explosive twisting and pushing force on the opponent which tends to turn the opponent and push him to one side. The player doing the blocking must smoothly and quickly move his hips in a roll and drive motion, forcefully pivot the upper body relative to the lower body, and push the body and arms forward through the weight load to accomplish the most effective and powerful blocking movement. This explosive movement employs the legs, hips, lower back, lower abdominal, upper abdominal, rotator and side lateral muscle groups, chest, upper back, shoulders, arms, and groin area. This movement also requires the athlete to pull, turn and push while driving the hips and legs into the weight load.

A strong athlete is not necessarily a powerful athlete and strength alone will not achieve the best results on the field of play. In blocking actions, the explosive movement requires the athlete to turn and push a heavy resistive weight over a full range of rotational movement at a high rate of speed. While an athlete may acquire strength from lifting weights, powerful blocking technique requires performing multiple sets of repetitions of the desired movement at a predetermined weight load within a predetermined number of seconds.

While there are many devices which teach the art of blocking, none of these devices promotes the mastery of, or conditions the muscles in the manner utilized in the explosive hip roll, drive, and twisting motions described above. Most of the conventional blocking devices merely train a player to charge towards an object, and provide some resistance to the force exerted by the charging player.

There are several patents which disclose various exercise machines for conditioning and strengthening athletes and other apparatus particularly designed for training football players.

Brentham, U.S. Pat. No. 3,822,599 discloses an exercise device comprising a handle pivotally mounted on a frame with a hydraulic system connected to the handle to exert a regulated force restraining movement of the handle.

Telle, U.S. Pat. No. 4,357,010 discloses an exercise apparatus for developing selected muscles of the body comprising a rigid upright support having a first beam pivoted on a horizontal axis near the top of the support and a second beam similarly pivoted below the first beam. The two beams are connected by a telescopic link to move together. Handles and shoulder pads are provided for lifting the first beam and a weight holding rod on the outer end of the second beam receives a selected number of weights to be lifted. The rate of movement of the beams is maintained substantially constant by a hydraulic cylinder.

Palladino, Jr., U.S. Pat. No. 4,720,103 discloses a training device for football players to train the user in the art of blocking. The apparatus includes a frame which defines an upwardly-sloping track, and a carriage which moves along the track. The carriage is connected by a pulley system to a hydraulic or pneumatic cylinder or the equivalent for imparting resistance to the movement of the carriage along the track.

Lundgren, U.S. Pat. No. 4,722,522 discloses an exercise machine comprising an operating bar which can be moved between operating positions at least 180 degrees apart, and a sprocket on the axis of motion carries a chain connected to a lever for exerting a near constant reaction force or torque. A bellcrank on the same axis carries weights that provide a variable force or torque on the movable bar. The user assumes one position to exercise the biceps and another position to exercise the triceps.

Fuller, U.S. Pat. No. 5,058,884 is my previous patent for an exercise machine which is particularly useful in developing the ability of an offensive or defensive lineman to smoothly and quickly pivot the upper body upwardly relative to the lower body by forcefully moving his hips in a roll and drive motion through a resistive weight load. The present invention is an improvement over my previous patent in that it incorporates structural elements which require the user to pull, turn, and push, and thus rotate the upper body relative to the lower body while also pivoting the upper body upwardly relative to the lower body by forcefully moving his hips in a roll and drive motion through a resistive weight load. This exercise strengthens the lower back, rotator, and side lateral muscle groups, as well as the groin area and other muscle groups.

The present invention is distinguished over the prior art in general, and these patents in particular by an exercise machine having a frame base with a platform at the rearward end upon which the athlete stands. A horizontal shaft rotatably mounted on a pair of vertical frame members near the forward end of the base has an upper central sprocket at its center and smaller sprockets at each end. A weight lever member pivotally connected to a pair of upright frame members extends forwardly therefrom and a number of weights are received on the outer end of the weight lever. A lower central sprocket is rotatably mounted between the upright frame members. A drive arm is arm pivotally connected at its bottom end to the platform. A handlebar rotatably mounted at the upper end of the drive arm is positioned a selective distance above the platform and has hand grips at each end. A first chain wrapped around the upper and lower central sprockets has its free end connected to the drive arm and a pair of second chains each wrapped around an outer sprocket in the opposite direction have their free ends connected to the weight lever member. When the drive arm is pushed pivotally outward by a force on the handlebar, it pulls the first chain down causing rotation of the upper central sprocket and outer sprockets which causes the second chains to pivot the weight lever member upward raising the weights at the outer end thereof and the weight thereof resisting the outward force applied to the handlebar.

The present exercise machine is particularly useful in developing the ability of an offensive or defensive lineman to smoothly and quickly roll his hips and pivot the upper body and forcefully move his body and arms in a lateral driving motion through a resistive weight load to accomplish the most effective and powerful blocking movement. The present invention conditions and strengthens the specific muscle groups employed in this explosive movement. The invention can also be used simply as an exercise machine, even by persons who are not trying to improve their blocking skills.

SUMMARY OF THE INVENTION

It is therefore an object of the present invention to provide an exercise machine which aids a football player in perfecting the art of blocking.

It is another object of this invention to provide an exercise machine which strengthens and conditions the specific muscle groups used in an effective blocking motion.

Another object of this invention is to provide an exercise machine which conditions a football player to smoothly and quickly pivot the upper body relative to the lower body by forcefully moving his hips in an explosive roll and drive motion through the weight load so as to push his opponent to one side or the other.

Another object of this invention is to provide an exercise machine which conditions a football player to smoothly and quickly roll his hips in an explosive rolling motion, pivot the upper body relative to the lower body, and forcefully drive his body and arms forward and downward through a weight load so as to force his opponent to one side and push him to the ground.

Another object of this invention is to provide an exercise machine which conditions a football player to smoothly and quickly pull, turn and push while forcefully moving his hips in an explosive roll and drive motion through a weight load.

Another object of this invention is to provide an exercise machine which teaches a football player to block an opponent, wherein the resistive weight load can be varied.

Another object of this invention is to provide an exercise machine which strengthens and conditions the legs, hips, lower back, lower abdominal, upper abdominal, rotator and side lateral muscle groups, chest, upper back, shoulders, arms, and groin area of athletes.

A further object of this invention is to provide an exercise machine which beneficial to a wide range of other athletes such as such as wrestlers and in developing the twisting power in the swinging of a bat for baseball players, and may also be used simply as an exercise machine for anyone desiring to strengthen and condition the major muscle groups of the body.

A still further object of this invention is to provide an exercise machine which is simple in construction, economical to manufacture, and rugged and reliable in use.

Other objects of the invention will become apparent from time to time throughout the specification and claims as hereinafter related.

The above noted objects and other objects of the invention are accomplished by the present exercise machine which has a frame base with a platform at the rearward end upon which the athlete stands. A horizontal shaft rotatably mounted on a pair of vertical frame members near the forward end of the base has an upper central sprocket at its center and smaller sprockets at each end. A weight lever member pivotally connected to a pair of upright frame members extends forwardly therefrom and a number of weights are received on the outer end of the weight lever. A lower central sprocket is rotatably mounted between the upright frame members. A drive arm is arm pivotally connected at its bottom end to the platform. A handlebar rotatably mounted at the upper end of the drive arm is positioned a selective distance above the platform and has hand grips at each end. A first chain wrapped around the upper and lower central sprockets has its free end connected to the drive arm and a pair of second chains each wrapped around an outer sprocket in the opposite direction have their free ends connected to the weight lever member. When the drive arm is pushed pivotally outward by a force on the handlebar, it pulls the first chain down causing rotation of the upper central sprocket and outer sprockets which causes the second chains to pivot the weight lever member upward raising the weights at the outer end thereof and the weight thereof resisting the outward force applied to the handlebar.

DESCRIPTION OF THE PREFERRED EMBODIMENT

Figure 1:
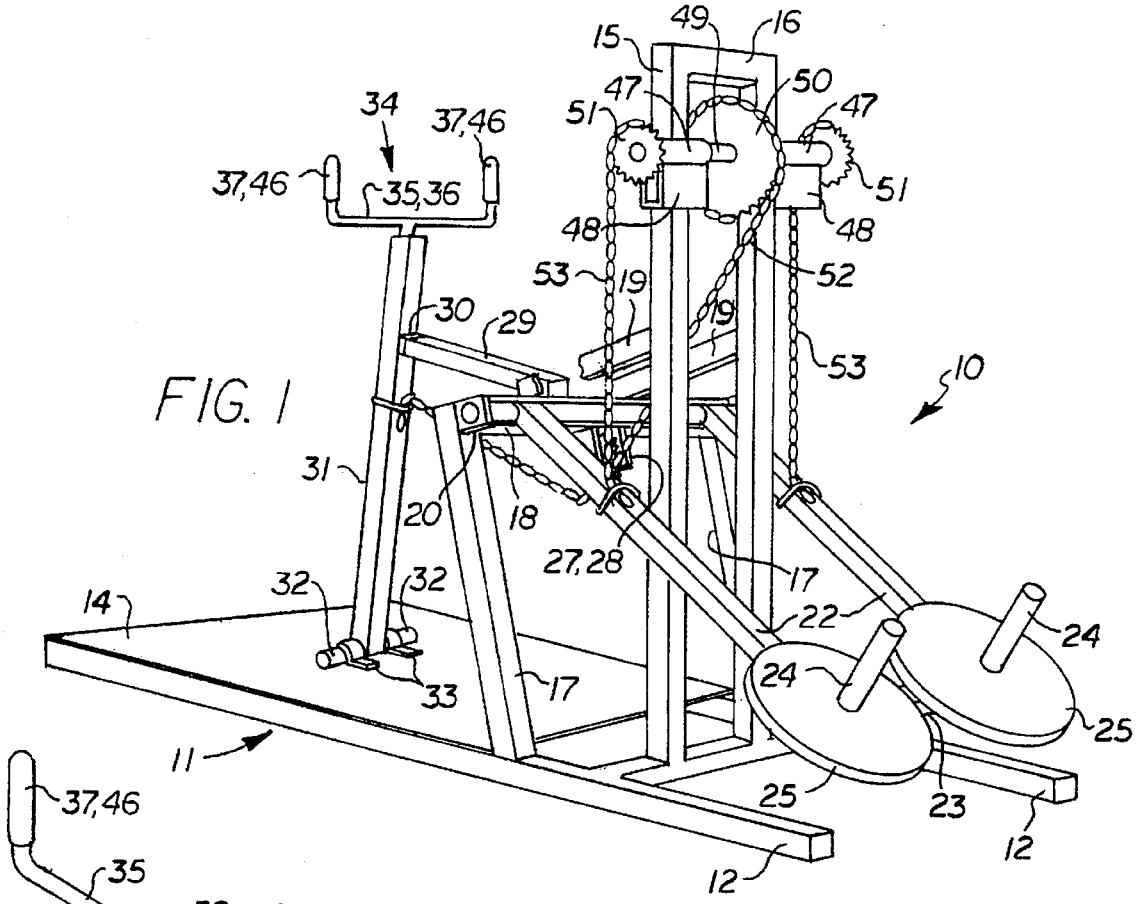
FIG. 1 is a perspective view of the exercise machine for conditioning athletes in accordance with the present invention.
Figure 2:
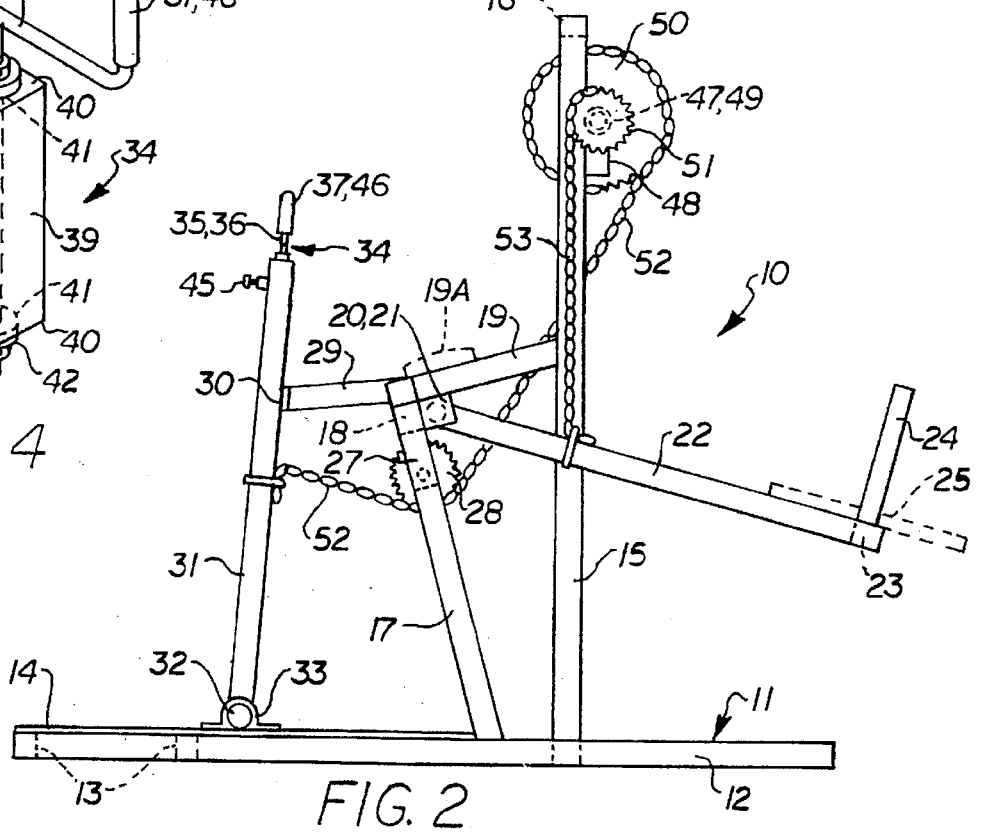
FIG. 2 is a side elevation of the exercise machine of FIG. 1.
Figure 3:
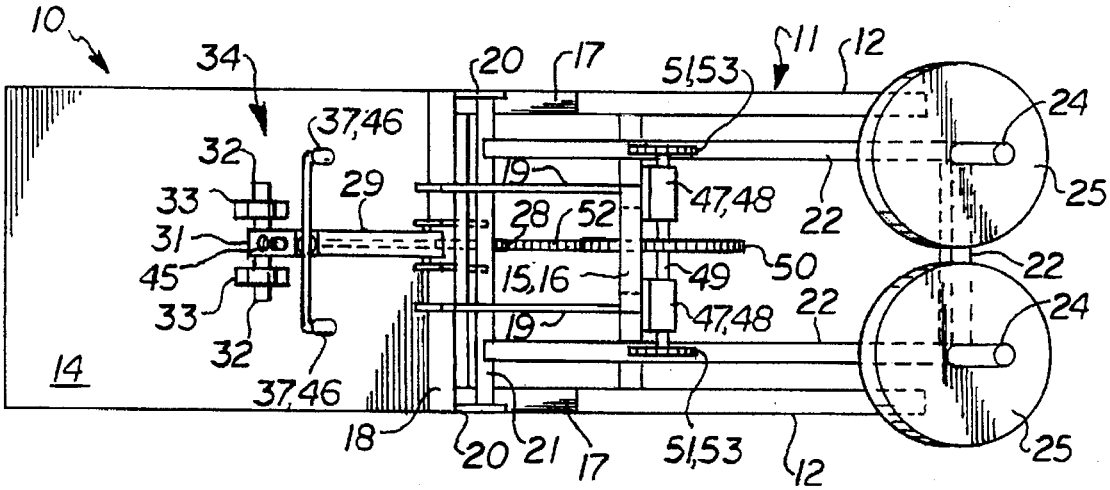
FIG. 3 is a top plan view of the exercise machine of FIG. 1.

Referring to the drawings by numerals of reference, there is shown in FIGS. 1, 2, and 3, a preferred exercise machine 10 which develops the ability of an offensive or defensive lineman to smoothly and quickly pivot the upper body relative to the lower body by forcefully rolling his hips and upper body in a drive and twisting motion laterally through a resistive weight load to accomplish the most effective and powerful blocking movement.

The exercise machine 10 comprises a frame 11 having a pair of elongate parallel spaced base members 12 of square tubing. One or more cross members 13 are secured transversly between the base members 12 at longitudinally spaced locations. A foot platform 14 of flat plate is secured to the top of the base members 12 at one end to extend transversly between the base members to provide a surface upon which the athlete stands.

A pair of parallel spaced vertical members 15 of square tubing are secured at their bottom ends to a cross member 13 near the end opposite the foot platform 14. The vertical members 15 are spaced laterally inward relative to the base members 12. A horizontal upper cross member 16 is secured transversly between the vertical members 15 at their top ends.

A pair of upright members 17 of square tubing are secured at their bottom ends one to each to base member 12 in laterally opposed relation and extend angularly upwardly therefrom sloping toward the platform 14. An upper cross member 18 of square tubing is secured transversly between upper ends of the upright members 17. A pair of braces 19 are secured between the cross member 18 and each vertical member 15. A pair of rectangular straps or brackets 20 are secured at the upper ends of the upright members 17 and extend outwardly therefrom. A round bar 21 is rotatably mounted between the brackets 20.

A pair of elongate weight arms 22 of square tubing are secured to the round bar 21 and extend angularly outward and downward therefrom just outside the vertical members 15. A cross member 23 is secured transversly between the weight arms 22 at their outer ends. A round bar 24 secured to the top surface of the outer ends of each weight arm extends upwardly therefrom to receive weights 25. The weight arms 22 are pivotally raised and lowered about the axis of the round bar 21 as it rotates as explained hereinafter.

A pair of parallel spaced rectangular straps or brackets 27 are secured to the bottom side of the cross member 18 near its center and extend downwardly therefrom. A chain sprocket 28 is rotatably mounted between the brackets 27. A rectangular stop member 29 of square tubing is secured at one end to the cross member 18 near its center and extends outwardly therefrom above the platform 14. An end cap 30 is installed on the outer end of the stop member 29. An elongate drive arm 31 of square tubing is pivotally connected at its bottom end to the platform 14 by pair of round bars 32 which extend laterally outward to each side of its bottom end and are journalled in pillow blocks 33 mounted on the platform. In an at-rest position, the drive arm 31 is supported against the outer end of the stop member 29.

Figure 4:
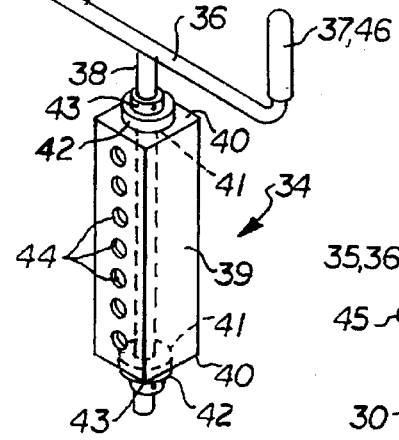
FIG. 4 is a longitudinal cross section of the rotating handlebar assembly of the exercise machine.

Referring now additionally to FIG. 4, a rotating handlebar assembly 34 is slidably received in the open top end of the drive arm 31. The handlebar assembly 34 has a generally T-shaped handlebar 35 with a horizontal portion 36 and vertical hand grip portions 37 at each end and a vertical shaft 38 extending downwardly from the center of the horizontal portion. The shaft 38 extends rotatably through a housing 39 of square tubing enclosed at each end by end walls 40. The shaft 38 extends rotatably through apertures 41 in the end walls 40 of the housing 39. A pair of bearings 42 are received on the shaft 38 and are maintained against the outer surfaces of the end walls 40 of the housing 39 by lock collars 43 with set screws.

One side of the housing 39 is provided with a series of longitudinally spaced holes 44. The housing 39 is slidably received in the top end of the drive arm 31 and a lock screw 45 threadedly mounted through the side wall of the extension 31 is received in one of the holes 44 to secure the handlebar assembly 34 at the desired height. Padded hand grips 46 may be provided on the upwardly extending hand grip portions 37 of the handlebar 35. Thus, it can be seen that the handlebar 35 rotates about the longitudinal axis of the drive arm 31.

A pair of hollow tubular members 47 are secured in horizontal axial alignment one to each vertical member 15 near their upper ends, and a pair of square tubular members 48 are secured to the vertical members 15 and to the horizontal tubular members 47 for support.

A shaft 49 is rotatably mounted through the hollow tubular members 47 and extends outwardly to each side thereof. A sprocket 50 is mounted at the center of the shaft 49 and a pair of smaller sprockets 51 are mounted one on each outer end of the shaft.

A chain 52 is wrapped around a segment of the larger sprocket 50 and a segment of the sprocket 28 and has a free end connected to the drive arm 31. A pair of chains 53 are wrapped, one around a segment of each smaller sprocket 51 and each chain has a free end connected to one of the weight arms 22. The chains 52 and 53 are wrapped in opposite directions around the sprockets 50 and 51 respectively.

Figure 6:
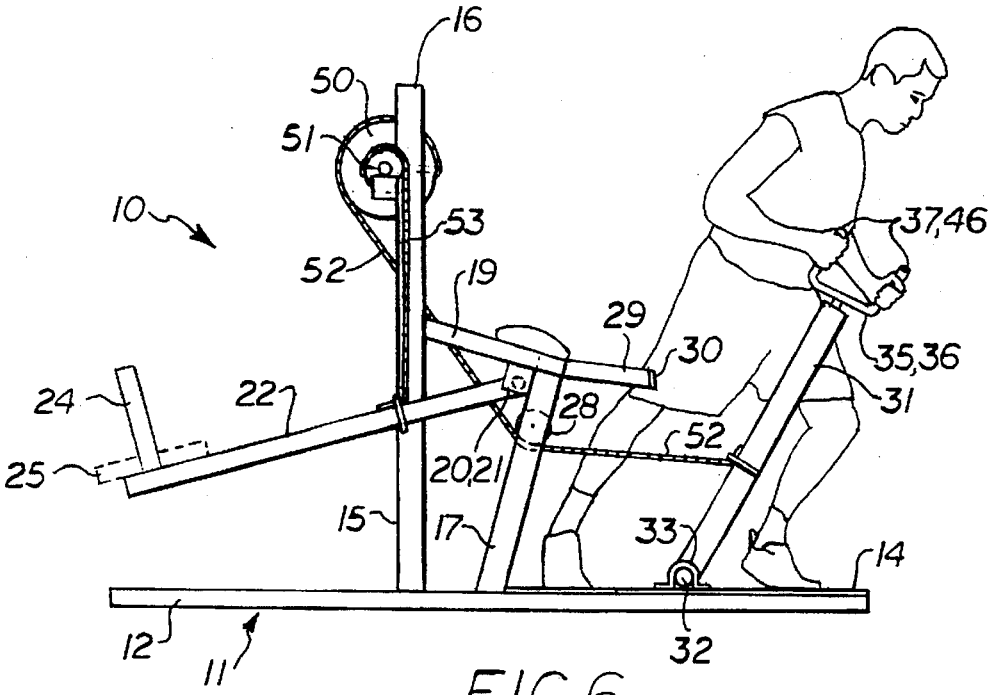
FIG. 6 is a side elevation showing the person midway through the lateral drive and twisting movement.
Figure 7:
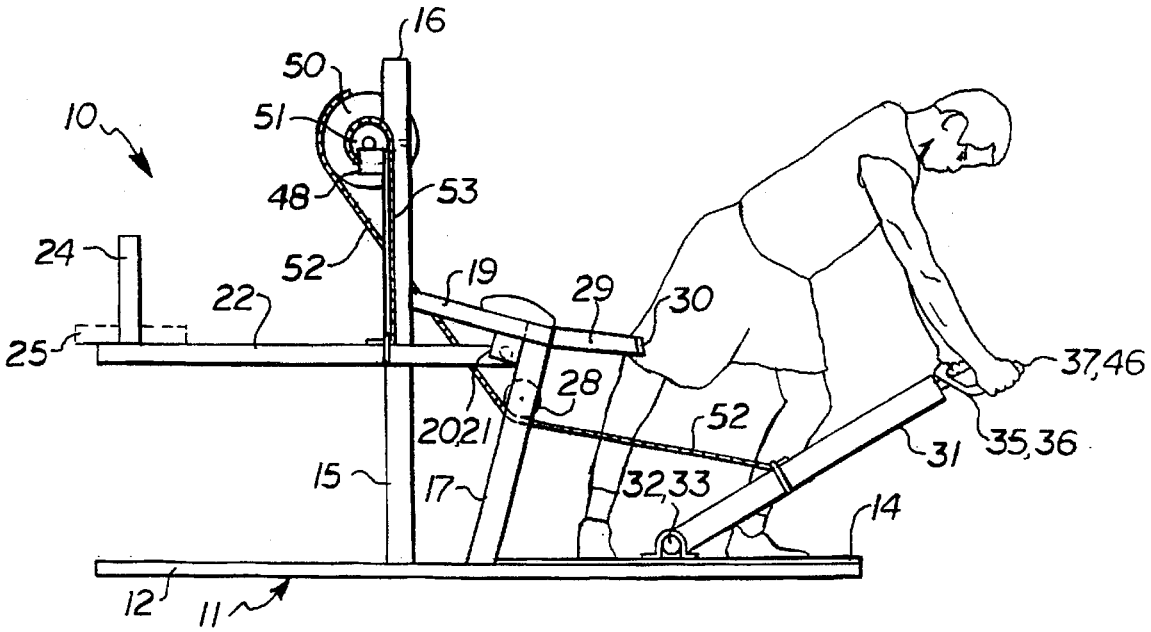
FIG. 7 is a side elevation showing the person at the completion of the lateral drive and twisting movement.

As shown in FIGS. 6 and 7, when the drive arm 31 is pivoted outwardly from the stop member 29 by a force on the handlebar 35, the drive arm 31 pulls the end of the chain 52 downward and rotates the larger sprocket 50. Rotation of the sprocket 50 rotates the shaft 49 and the smaller sprockets 51 at its ends, causing the ends of chains 53 to pull upward on the weight arms 22, pivoting them upward about the axis of the round bar 21 and raising the weights 25. Resistance to the pushing force applied to the handlebar 36 and drive arm 31 is determined by the weights 25 installed on the round bars 24 at the outer ends of the weight arms 22.

OPERATION

Figure 5:
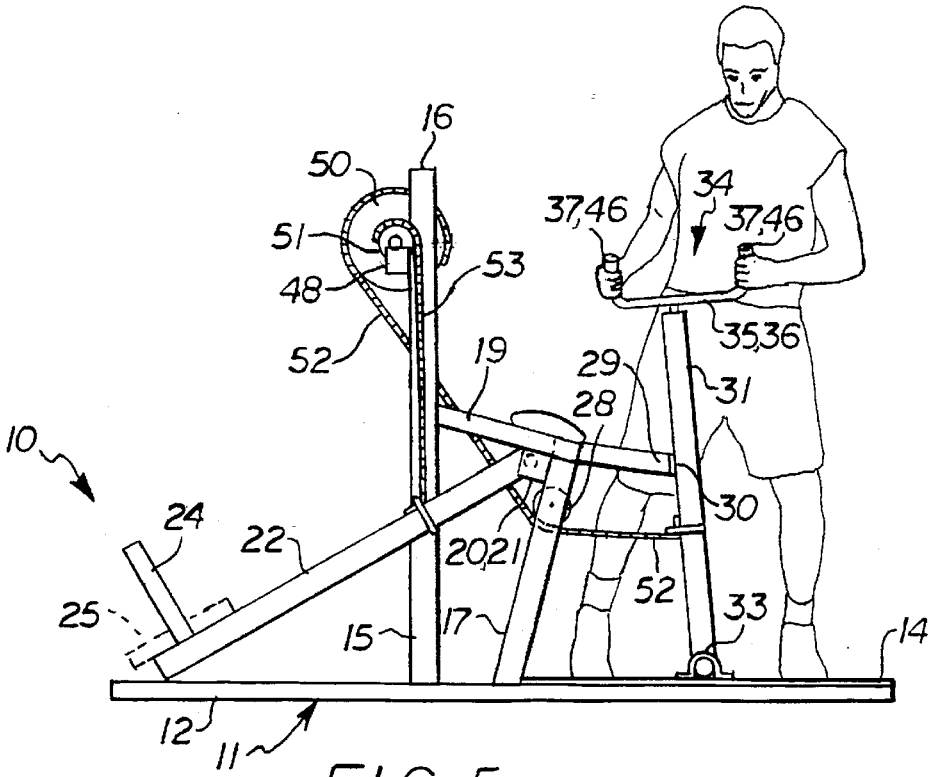
FIG. 5 is a side elevation of the exercise machine seen from the side opposite that of FIG. 2, showing a person using the exercise machine with the hands placed on the hand grips of the handlebar at the beginning of a lateral drive and twisting movement.

To use the exercise machine 10, the height of the handlebar 35 is secured at a distance above the platform 14 such that the handlebar 35 is about waist high on the athlete and the proper number of weights 25 are placed on the rods 24. As shown in FIG. 5, the athlete stands on the platform 14 on one side of the drive arm 31 with the feet spread apart and grasps the hand grips 45 of the handlebar 34.

The body movement is initiated with the hips. In one smooth movement, the hips are forcefully and quickly rolled about 90° while at the same time rotating the upper torso until the athlete is facing the end of the machine and then driving the body against the weight load to pivot the drive arm 31 outwardly and downwardly (FIG. 6) and finishing the movement with a full extension of the arms which further pivots the drive arm 31 against the resistive weight load (FIG. 7). In this movement, the lower body and particularly the hips initially activate the weight load and the upper body and arms finish out the explosive lateral twisting and driving action. This motion particularly strengthens the lower back, rotator, and side lateral muscle groups, and involves all the major muscle groups in the body including the muscles of the legs, hips, lower back, lower abdominal, upper abdominal, chest, upper back, shoulders, arms, and groin area which are activated together through one simultaneous explosive movement. This exercise also requires the athlete to pull, turn and push while driving the hips and legs into the weight load.

This maneuver closely simulates the movements required by a defensive lineman on a football team. The machine is also beneficial to other athletes such as such as wrestlers and developing the twisting power in the swinging of a bat for baseball players.

When the drive arm 31 is pivoted outward by the force on the handlebar 34, the drive arm pulls the end of the chain 52 down and rotates the larger sprocket 50. Rotation of the sprocket 50 rotates the shaft 49 and the smaller sprockets 51 at its ends causing the ends of chains 53 to pull upward on the weight arms 22 pivoting them upward about the axis of the round bar 21. Resistance to the upward force applied to the handlebar 34 and drive arm 31 is determined by the weights 25 installed on the round bars 24 at the outer ends of the weight arms 22.

A set of eight to twelve repetitions twisting to each side is recommended and should be accomplished in approximately fifteen seconds. Different muscle fibers are affected by a quick movement than by a slow movement. Moving through the explosive maneuver rapidly develops and conditions the white, or "fast twitch" muscle fibers. Red, or "slow twitch" muscle fibers are used in slow movements such as in simple weight lifting exercises. Power developed by quickness in overcoming an increasing weight load. In other words, if it takes one person a minute to move weight a certain distance and another person can do it in three seconds, he is said to have more power.

Power, rather than strength alone, is what will achieve the best results on the field of play. In blocking actions, the explosive movement requires the athlete to lift a heavy resistive weight over a full range of upward movement at a high rate of speed. While an athlete may acquire strength from lifting weights, powerful blocking technique requires performing multiple sets of repetitions of the desired movement at a predetermined weight load within a predetermined number of seconds. The present exercise machine will condition an athlete to be quick, powerful, and explosive.

As shown in dashed line in FIG. 2, a padded seat 19A may optionally be installed on the braces 19. In this modification, the athlete may sit on the seat 19A facing the drive arm, and push the drive arm outwardly against the weight load to perform a seated chest press exercise.

While this invention has been described fully and completely with special emphasis upon a preferred embodiment, it should be understood that within the scope of the appended claims the invention may be practiced otherwise than as specifically described herein.

I claim:

1. An exercise machine for conditioning athletes comprising:

a frame having a generally rectangular base portion for supporting the frame on a flat surface and having forward and rearward ends, a platform at the rearward end of the base portion upon which a person may stand, a pair of parallel laterally spaced vertical members near the forward end of said base portion, and a pair of laterally spaced upright members on the base portion between the foot platform and the vertical members;

a weight lever pivotally mounted at one end to said upright members on a horizontal axis and extending forwardly therefrom and having weight receiving means at its outer end for receiving a selected number of weights to be lifted;

an elongate, upstanding drive arm having a bottom end and an upper end, said drive arm pivotally connected at said bottom end to said platform to pivot said upper end outwardly and downwardly relative to said vertical members;

a horizontal handlebar adjustably and rotatably mounted at the upper end of said drive arm to rotate about the longitudinal axis of said drive arm and having laterally spaced hand grip members at opposed ends, and being positionable a selective distance above said platform;

a horizontal shaft rotatably mounted at an upper end of said vertical members and extending outwardly to each side thereof, an upper central sprocket secured at the center of said shaft and a pair of second sprockets secured one on each outer end of said shaft;

a lower central sprocket rotatably mounted between said laterally spaced upright members;

a first chain wrapped around a segment of said upper central sprocket and a segment of said lower central sprocket and its free end connected to said drive arm;

a pair of second chains each wrapped around a segment of each said second sprocket and the free end of each connected to said weight lever;

said first chain and said second chains being wrapped in opposite directions around said upper central sprocket and said second sprockets, respectively, so that upon said drive arm upper portion being pivoted outwardly and downwardly by a downward rotary force on said handlebar, said drive arm will pull said first chain down causing rotation of said upper central sprocket and said horizontal shaft and said second sprockets at its outer ends to simultaneously cause said second chains to pull upward on said weight lever to pivot it upward with the weights at the outer ends thereof resisting the pivotal movement of said drive arm; whereby a downward rotary force may be applied to said handlebar by a person standing upright on said platform gripping said hand grip members and quickly rolling his or her hips forward and twisting their upper torso to one side and finishing the movement with a full extension of the arms to drive their body and extend their arms downwardly against the resistive weight load.

2. The exercise machine according to claim 1 in which said handlebar comprises a generally T-shaped bar member having a horizontal portion with said hand grip members at each end and a central vertical shaft rotatably secured in a tubular housing, and said tubular housing is slidably received within said drive arm upper end and releasably secured therein by locking means at selective positions for adjustably positioning said horizontal portion a distance above said platform to accommodate persons of various size.

3. The exercise machine according to claim 1 in which said frame base portion comprises a pair of elongate parallel spaced tubular base members with longitudinally spaced cross members secured transversly therebetween, and said platform is a flat plate secured to the top of said base members at one end to extend transversly therebetween;

said vertical members comprise a pair of parallel spaced vertical tubular members secured at their bottom ends to a said cross member near the end opposite said foot platform and positioned laterally inward relative to said base members and joined at their upper ends by a horizontal cross member secured transversly therebetween;

said upright members are secured at their bottom ends one to each said base member in laterally opposed relation to extend upwardly therefrom and joined at their upper ends by a horizontal cross member secured transversly therebetween; and said weight lever comprises a pair of parallel elongate tubular weight arms each pivotally mounted at one end to the horizontal upper cross member of said upright member and extending outwardly therefrom laterally spaced at each side of said vertical members and joined at their outer ends by a cross member secured transversly therebetween.

* * * * *